US006477722B2

(12) United States Patent
Busatta

(10) Patent No.: US 6,477,722 B2
(45) Date of Patent: Nov. 12, 2002

(54) OVERFLOW SYSTEM WITH A SPILLWAY RIM, PARTICULARLY FOR A PREFABRICATED SWIMMING POOL TO BE SUNK INTO THE GROUND, AND A METHOD AND APPARATUS FOR ITS CONSTRUCTION

(76) Inventor: Paolo Busatta, Via Cigliano 1/A, I-10030 Torre Balfredo D'Ivrea (Torino) (IT)

( * ) Notice: Subject to any disclaimer, the term of this patent is extended or adjusted under 35 U.S.C. 154(b) by 0 days.

(21) Appl. No.: 09/837,180

(22) Filed: Apr. 19, 2001

(65) Prior Publication Data

US 2002/0002802 A1 Jan. 10, 2002

(30) Foreign Application Priority Data

Apr. 20, 2000 (IT) ..... TO20A0377

(51) Int. Cl.[7] ..... E04H 4/00
(52) U.S. Cl. ..... 4/507
(58) Field of Search ..... 4/506, 507, 508

(56) References Cited

U.S. PATENT DOCUMENTS 4,146,937 A * 4/1979 Baker ..... 4/508 X
4,553,356 A * 11/1985 Pepper ..... 52/11

FOREIGN PATENT DOCUMENTS

FR 2 718 179 A 3/1995

* cited by examiner

*Primary Examiner*—Charles E. Phillips
(74) *Attorney, Agent, or Firm*—Sughrue Mion, PLLC

(57) ABSTRACT

The overflow system comprises: a plurality of U-shaped support brackets each fixed, by one of its vertical portions, to the outer side of the wall structure of the swimming pool, a plurality of flexible panels anchored to the vertical portions of the brackets so as to form two facing sides, a base formed by a casting of material which can be cast and set, cast in situ between the sides, and an upper spillway profile fixed in a watertight manner between the wall structure and the inner side of the overflow duct.

13 Claims, 2 Drawing Sheets

OVERFLOW SYSTEM WITH A SPILLWAY RIM, PARTICULARLY FOR A PREFABRICATED SWIMMING POOL TO BE SUNK INTO THE GROUND, AND A METHOD AND APPARATUS FOR ITS CONSTRUCTION

BACKGROUND OF THE INVENTION

The present invention relates to swimming pools and, in particular, to prefabricated swimming pools to be sunk into the ground and comprising a side wall structure to be erected in an installation pit, for example, of the type forming the subject of prior Italian patent application PD94A000058.

The construction of overflow systems with spillway rims is relatively easy for swimming pools with straight shapes, for example, square or rectangular pools, but is quite problematical for swimming pools having at least partially curved shapes.

SUMMARY OF THE INVENTION

An object of the present invention is to provide an overflow system which is also easy to construct for swimming pools with curved and freely-shaped edges.

This and other objects are achieved, according to the invention, by an overflow system the main characteristics of which are defined in appended claim 1, by the method for its construction as defined substantially in appended claim 12.

BRIEF DESCRIPTION OF THE DRAWINGS

Further characteristics and advantages of the invention will become clear from the following detailed description, given purely by way of non-limiting example, with reference to the appended drawings, in which;

In FIG. 1, a prefabricated swimming pool to be sunk into the ground is general indicated 1.

DETAILED DESCRIPTION OF THE INVENTION

Figure 1:
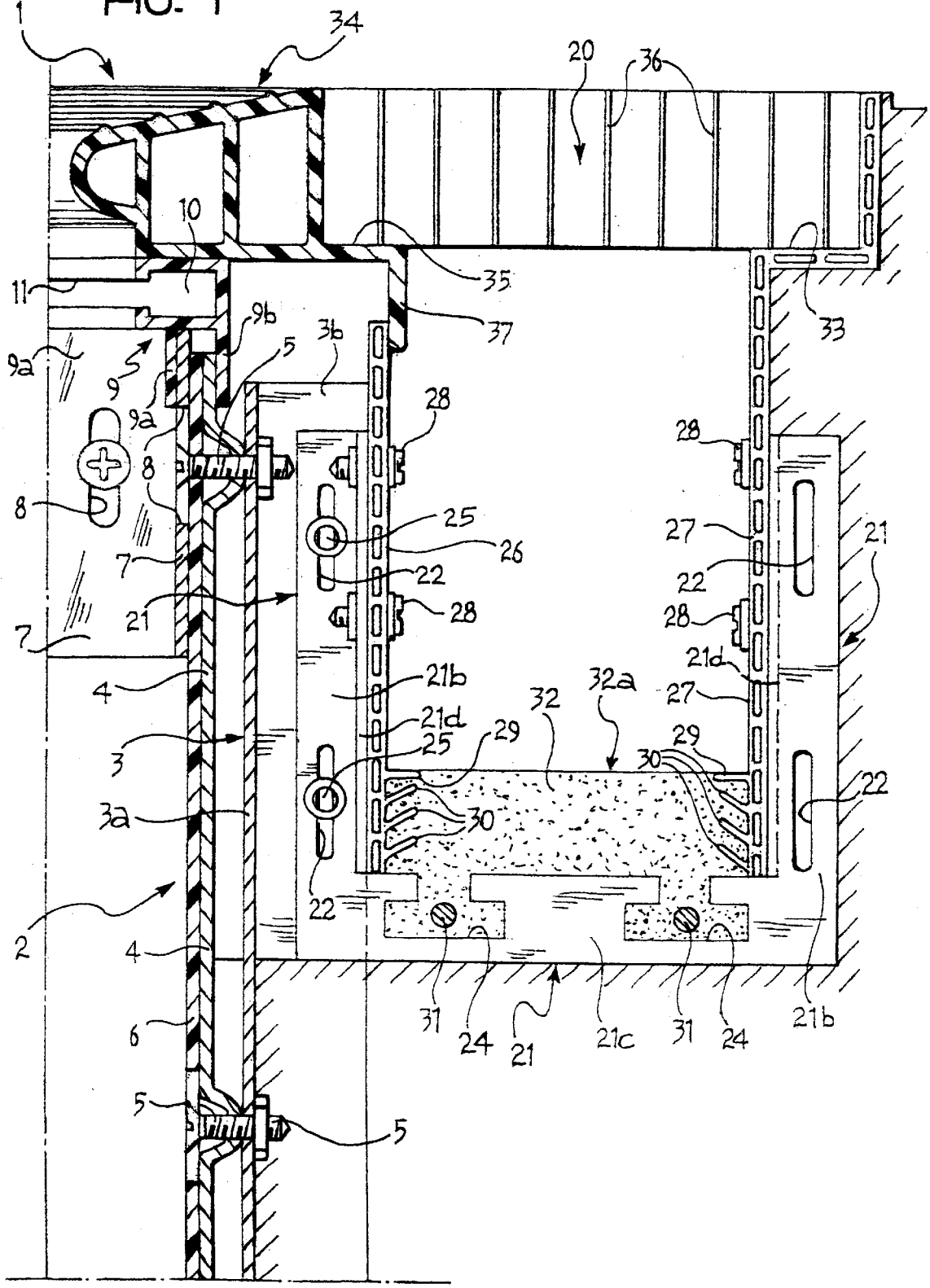
FIG. 1 is a view showing an overflow system according to the invention, partially in cross-section.

The swimming pool 1 comprises, in known manner, a side wall structure generally indicated 2. In the embodiment shown, the wall structure 2 comprises a plurality of uprights or supports 3 constituted by channel sectioned metal profiles (see FIG. 2), to which a plurality of ribbed panels 4, preferably of metal, are connected. The ribbed panels 4 are placed against the central webs 3*a* of the uprights 3 and are fixed firmly thereto by means of bolts, indicated 5 in FIG. 1. The panels 4, which are arranged in succession around the closed shape of the side wall of the swimming pool, are covered, on the side facing the interior of the swimming pool, by flat sheets or plates 6, for example, of polyester, to give the inner wall of the swimming pool a flat surface which facilitates its maintenance and cleaning.

Levelling strips 7, for example of metal, are fitted in the vicinity of the upper ends of the plates or sheets 6, on their faces facing the interior of the pool. These strips have slot-like holes a arranged substantially vertically.

The bolts 5 are engaged through these slots and, in the upper portion of the wall structure, hold together the levelling strips 7, the plates or sheets 6 and the ribbed panels 4. In particular, the slots 8 enable the levelling strips 7 to be positioned in a manner such that their upper edges are actually coplanar, with a view to the fitting thereon of an engagement profile, indicated 9 in the drawings. This profile, which is made, for example, of extruded PVC, has two substantially parallel lower flanges 9*a* and 9*b* which, as can be seen in FIG. 1, clasp the unit formed by the levelling strips 7, the ribbed panels 4, and by the covering plates 6, in the mounted condition.

A chamber 10 defined in the upper portion of the engagement profile 9 has a slot-like opening 13 facing towards the interior of the swimming pool. An edge portion of a continuous flexible cover or sheet, for example of PVC or other suitable material, which covers the entire pool, for example, as described in the above-mentioned prior patent application, is intended to be engaged in the chamber 10, in per se known manner.

The swimming pool 1 shown in FIG. 1 has an overflow duct, generally indicated 20 around the wall structure 2. This duct is advantageously constructed in the following manner.

A plurality of substantially u-shaped support brackets 21, for example, of steel, are fixed to the outer aide of the wall structure 2.

In the embodiment shown by way of example, (see FIG. 2 in particular) the vertical portions 21*a* of each support bracket 21 have a dihedral shape with respective flanges 21*b* that are coplanar with one another and with a base portion 21*c* of the bracket, and respective flanges 21*d* that are bent substantially at 90° to the flanges 21*b*. Moreover, the flanges 21*d* of the two vertical portions of each bracket 21 are preferably turned to opposite sides.

Respective slot-like holes 22 are formed in the flanges 21*b* of the vertical portions of each bracket.

Figure 2:
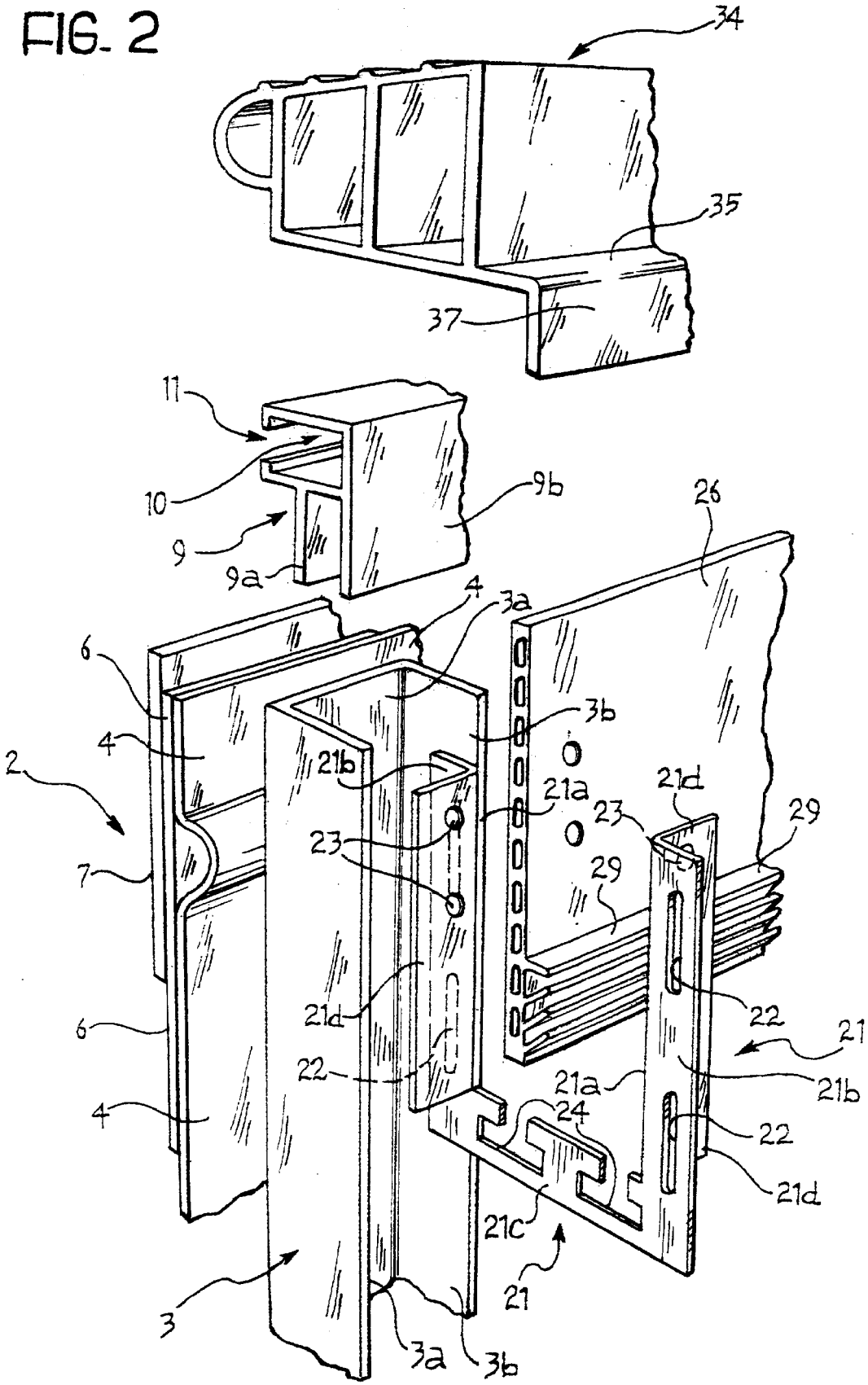
FIG. 2 is a partially exploded, partial perspective view of the overflow system of FIG. 1.

The flanges 21*d*, on the other hand, have respective holes 23 (FIG. 2).

Moreover, a plurality of notches 24 which, in the embodiment shown by way of example, have an inverted T-shape and are open at the top, are preferably formed in the lower or central portion 21*c* of each bracket 21.

Each bracket 21 is fixed to a lateral flange 3*b* of an upright 3 of the swimming-pool wall structure 2. The fixing is achieved by screws or bolts 25 (FIG. 1) which extend through corresponding holes formed in the upright, as well as through the slots 22 in one vertical portion of a bracket. These slots enable the brackets to be mounted in a manner such that their lower or central portions 21*c* are substantially coplanar.

It should be noted that, in the embodiment shown, each bracket 21 has a symmetrical shape so that it can equally well be fixed to either of the vertical flanges of an upright 3 of the wall structure 2.

Once the brackets 21 have been fixed to the uprights 3 of the wall structure 2, flexible panels 26 and 27, for example of plastics material and possibly ribbed, are anchored to the vertical portions of the brackets so as to form the two facing sides of the overflow duct 20. In particular, the panels 26 and 27 are anchored to the flanges 21*a* of the 11vertical portions of the brackets 21, for example, by means of screws or bolts such as those indicated 29 in FIG. 1.

The panels 26 and 27 advantageously but not necessarily have a plurality of substantially horizontal ribs in their lower portions. In particular, each of the panels has an upper, substantially horizontal rib 29 and, a plurality of lower ribs 30 which are preferably inclined to the horizontal.

During the construction of the overflow duct, after the panels 26 and 27 have been anchored to the support brackets 21, the region situated below these brackets is buried.

One or more reinforcing rods such as those indicated 31 in FIG. 1 are arranged in the notches 24 of the lower portions of the brackets 21.

A casting 32 (FIG. 2) of material which can be cast and set, for example, concrete, is then formed between the sides 26 and 27 in a manner such that the upper surface 12*a* of the casting is disposed above the level of the lower edges of the panels 26 and 27 and is preferably positioned in the region of the upper ribs 29. The ribs 30 are thus incorporated in the casting 32 and contribute to the formation of a firm anchorage between the casting 22 and the sides 26 and 27.

In the embodiment shown, the side panels 27 have a stepped shape at the top and, in particular, form a horizontal shoulder 33.

It will be noted that the panels 26 which form the inner side of the overflow duct 20 can be formed from the panels 27 by trimming of the top portion. This solution simplifies the production of the panels.

An upper spillway profile, generally indicated 34, is fixed in a watertight manner, for example, with the use of a liquid PVC-based glue, between the engagement profile 9 and the panels 26 which form the inner side of the overflow duct 20. In the embodiment shown, the portion of the spillway profile 34 which faces the overflow duct 20 forms a horizontal shoulder 35 which is coplanar with the shoulders 33 of the panels 27 that define the outer side of the overflow duct. Successive grill sections 36, which can be walked on and through which the water that overflows over the spillway profile 34 can flow and fall into the collecting duct 20, can advantageously be supported on the shoulders 33 and 35.

The horizontal shoulder 35 of the spillway profile 34 adjoins a flange 37 which is turned downwards, overlapping and possibly being sealed against the upper edges of the panels 26.

The upper surface 32*a* of the casting 32 may possibly be provided with a layer of protective and finishing paint.

The above-described overflow system can be constructed 31*g* easily with the use of a limited number of components. It enables overflow ducts even with tightly curved shapes to be constructed by virtue of the flexibility of the panels which constitute its sides and of the fact that the base of the duct is formed by a casting of material which can be cast and set in situ.

The above-described system has many advantages.

In the first place, the strips 7 provided with slots 8 enable the upper edge of the side wall of the swimming pool to be adjusted or levelled, over time, for example, to take up any subsidence/settlement of the ground on which the swimming pool is laid.

With the use of brackets of suitable dimensions, it is possible to produce overflow systems suitable for swimming pools of very different sizes.

Moreover, by adjusting the level of the panel 27 and of the spillway profile 34 at the installation stage, it is possible to give the grille 36 any desired slope, for example, a downward slope towards the interior of the swimming pool.

Naturally, the principle of the invention remaining the same, the forms of embodiment and details of construction may be varied widely with respect to those described and illustrated purely by way of non-limiting example, without thereby departing from the scope of the invention as defined in the appended claims.

What is claimed is:

1. An overflow system particularly for a swimming pool to be sunk into the ground and comprising a side wall structure, the system comprising:

a plurality of substantially U-shaped support brackets each fixed, by one of its vertical portions, to the outer side of the wall structure, a plurality of flexible panels anchored to the vertical portions of the brackets so as to form two facing sides of an overflow duct, a base formed by a casting of material which can be cast and set, cast in situ between the sides in a manner such that the upper surface of the casting is disposed above the level of the lower edges of the sides, and an upper spillway profile fixed in a watertight manner between the wall structure and the inner side of the overflow duct.

2. An overflow system according to claim 1 in which reinforcement means are associated with the central or lower portions of the brackets and are incorporated in the casting.

3. A system according to claim 1 in which the central or lower portion of each bracket has at least one notch, which is open at the top for the insertion of at least one reinforcing rod.

4. A system according to claim 1, in which the vertical portions of each bracket have a dihedral shape with a first flange and a second flange substantially perpendicular to one another.

5. A system according to claim 4 in which the vertical portions of each bracket have respective first flanges, coplanar with one another and with the lower or central portion of the bracket, and respective second flanges perpendicular to the first flanges and turned to opposite sides.

6. A system according to claim 1 in which the wall structure comprises a plurality of uprights each of which has a vertical flange arranged substantially perpendicular to the side wall of the swimming pool, and in which each bracket is fixed to the said vertical flange of one of the uprights.

7. A system according to claim 1 in which each flexible panel has, in its lower portion, at least one horizontal levelling fin corresponding to the upper surface of the casting.

8. A system according to claim 7 in which each flexible panel has at least one inclined anchoring fin incorporated in the casting.

9. A system according to claim 1 in which the flexible panels which form the outer side of the overflow duct form an upper, substantially horizontal shoulder for the support of a grill for filtering the water which overflows into the duct.

10. A system according to claim 9 in which the spillway profile forms a substantially horizontal shoulder for the support of the filtering grill.

11. A system according to claim 1 in which the wall structure comprises upper slotted levelling strips fixed in a manner such that their upper edges are substantially coplanar.

12. A method of constructing an overflow system particularly for a swimming pool to be sunk into the ground, comprising the steps of erecting a side wall structure in an installation pit for the swimming pool, the method comprising the steps of:

fixing a plurality of substantially U-shaped brackets to the outer side of the wall structure, anchoring flexible panels to the vertical portions of the brackets so as to form two facing sides for an overflow duct, forming a casting of material which can be cast and set in situ between the sides so that the upper surface of the casting is disposed above the level of the lower edges of the sides, and fixing an upper spillway profile in a watertight manner between the wall structure and the inner side of the overflow duct.

13. A method according to claim 12, wherein reinforcement means, preferably housed in corresponding seats provided in the support brackets, are incorporated in the casting.

* * * * *